United States Patent [19]

Gamm

[11] Patent Number: 4,630,383

[45] Date of Patent: Dec. 23, 1986

[54] SHOE WITH GUSSET POCKET

[75] Inventor: Robert J. Gamm, Olivette, Mo.

[73] Assignee: Kangaroos U.S.A., Inc., Chesterfield, Mo.

[21] Appl. No.: 516,647

[22] Filed: Jul. 25, 1983

Related U.S. Application Data

[63] Continuation of Ser. No. 190,791, Sep. 25, 1980, abandoned.

[51] Int. Cl.[4] ..... A43B 23/00

[52] U.S. Cl. ..... 36/136; 36/54; 36/134

[58] Field of Search ..... 36/136, 134, 54

[56] References Cited

U.S. PATENT DOCUMENTS

| | | | |
|---|---|---|---|
| D. 96,246 | 6/1935 | Gleason | 36/54 |
| D. 110,163 | 3/1938 | Andrews | 36/54 |
| D. 143,392 | 11/1944 | Barlow | 36/54 |
| D. 244,726 | 6/1977 | Katz . | |
| D. 247,932 | 5/1978 | Katz . | |
| D. 253,498 | 11/1979 | Katz . | |
| 601,192 | 3/1898 | Woodside . | |
| 654,388 | 7/1900 | Diemer . | |
| 910,308 | 1/1909 | Peters | 36/54 |
| 1,100,758 | 6/1914 | McAuslin . | |
| 1,190,305 | 7/1916 | Leichter | 36/54 |
| 1,213,036 | 1/1917 | Taylor . | |
| 1,229,940 | 6/1917 | Gomes | 36/54 |
| 1,289,341 | 12/1918 | Wirsching . | |
| 1,832,866 | 11/1931 | Johnson . | |
| 1,889,734 | 11/1934 | Stevenson . | |
| 2,095,869 | 10/1937 | Hermson . | |
| 2,421,796 | 6/1947 | Maling . | |
| 2,539,761 | 1/1951 | Whitman . | |
| 2,662,677 | 12/1953 | Perry . | |
| 2,712,700 | 7/1955 | Solomon . | |
| 2,908,982 | 10/1959 | Corley . | |
| 3,018,570 | 12/1960 | Bliese | 36/136 |
| 3,306,610 | 2/1967 | Biggs . | |
| 3,537,108 | 11/1970 | Daniels . | |
| 3,631,613 | 1/1972 | Brettell . | |
| 3,703,775 | 11/1972 | Gatti . | |
| 4,126,951 | 11/1978 | Antonious | 36/54 |
| 4,372,060 | 2/1983 | Adamik | 36/136 |
| 4,377,913 | 3/1983 | Stone | 36/54 |

FOREIGN PATENT DOCUMENTS

| | | | |
|---|---|---|---|
| 870963 | 7/1949 | Fed. Rep. of Germany . | |
| 1921508 | 10/1970 | Fed. Rep. of Germany . | |
| 1447044 | 6/1966 | France . | |
| 302520 | 10/1928 | United Kingdom . | |
| 302520 | 12/1928 | United Kingdom | 36/136 |
| 492247 | 9/1938 | United Kingdom . | |
| 1225359 | 1/1971 | United Kingdom . | |
| 1293925 | 10/1972 | United Kingdom . | |
| 1347424 | 2/1974 | United Kingdom . | |

OTHER PUBLICATIONS

"Velcro" advertisement in *Footwear News,* Mar. 8, 1976, p. 43.

"Rippers" advertisement in *Runner's World,* Aug. 1978, p. 29.

*Primary Examiner*—Werner H. Schroeder
*Assistant Examiner*—Mary A. Ellis
*Attorney, Agent, or Firm*—Paul M. Denk

[57] ABSTRACT

A pocket portion formed extending from the tongue or gusset of a shoe or other footwear and wherein personal items may be contained, the pocket portion is formed of a pair of upper and lower liners, stitched together along their periphery, and having a closure, such as a zipper, for the same after such items have been enclosed therein; the pocket portion can be contiguously held against the shoe upper by means of any fastening device, such as Velcro, a hooking device, or through the use of the lacing that normally secures the shoe upon the foot of the wearer.

6 Claims, 6 Drawing Figures

SHOE WITH GUSSET POCKET

CROSS REFERENCE TO RELATED APPLICATIONS

This application is a continuation of the application having Ser. No. 190,791, filed on Sept. 25, 1980, and now abandoned.

BACKGROUND OF THE INVENTION

This invention relates generally to footwear, and more particularly pertains to a pocket formed within or appended to the gusset or tongue of a shoe, and having utility for temporary storage of personal items during shoe usage, as when employed during sporting events, jogging, or the like.

One problem that repeatedly confronts the athlete, and particularly the modern sportsman who actively participates in golf, tennis, jogging, or the like, or even when partaking in various sports, such as hunting and fishing, is the ability to securely locate personal items in the category of tees, some loose change, money, and the like. Various means were earlier employed for assuring the safety of one's personal items, but particularly were designed for usage when some significant amounts of money were involved. For example, in the early United States patent to Diemer, U.S. Pat. No. 654,388, upon a shoe, means for securing valuable items concealingly within the calf portion of the shoe, and more specifically upon its internal portion that rest against the leg, was given consideration. Thus, the shown embodiment provided means for securing ones valuables such as money, and in addition to furnishing concealment of the same in the event that one was personally accosted, as by a theft. Various other forms of similar type pocket structures were used in association particularly with boots, as are also shown in the earlier United States patents to Wirsching, U.S. Pat. No. 1,289,341, McAuslin, U.S. Pat. No. 1,100,758, in addition to the patent to Avis, U.S. Pat. No. 1,342,149.

More contemporary inventors have given thought to various types of structure for forming pocket structures within shoes and boots, and such is shown in the United States patent to Corley, U.S. Pat. No. 2,908,082. In addition, the concept of adding decorativeness to the shoe through the addition of a purse or the like, as by attaching the same upon the frontal shoe upper, is shown in the United States patent to Bliese, U.S. Pat. No. 3,018,570, but the additional structure to form the purse as shown in this patent was integrally constructed into the vamp of the shoe itself, and therefore, made it difficult to insert and keys, money, or the like therein, and furthermore, when such objects of some hardness were located therein, would certainly constantly maintain pressure upon the foot of the wearer. The United States patent to Solomon, U.S. Pat. No. 2,712,700, shows another means for adding some decoration to a shoe through the addition of a purse, or the like. Furthermore, the adding of a holding means having some utility to the shoe, as by securing the same through its laces to the shoe, is shown in the golf tee holder as devised by Perry in his U.S. Pat. No. 2,662,677. Similar type devices are currently available upon the market. All of the foregoing embodiments have utility for holding some component of personal item, such as money, in a concealed fashion upon its wearer, while the current invention, to the contrary, intends to provide a pocket portion that can be built structurally and foldably onto the gusset or tongue of the footwear, so as to hold smaller personal items such as keys and money, while further incorporating, in its construction, various means for assuring the retention of the pocket portion onto and contiguously with the shoe upper portion, at the location of its lacings, so as to prevent the untimely loss of such items.

It is, therefore, the principal object of this invention to provide a pocket portion that is structurally built foldably onto the gusset or tongue portion of footwear, whether it be tennis shoes, jogging shoes, golf shoes, hunting shoes, work shoes, or standard dress shoes, and which incorporates closure means for the pocket portion so as to assure that personal items contained therein will not be inadvertently lost by the wearer.

Another object of this invention is to provide a pocket portion that is integrally structured foldably connected onto the tongue portion of the shoe gusset, and which can assure the safety of items enclosed therein, while at the same time enhancing the attractiveness of the footwear.

Another object of this invention is to provide fastening and securing means that snugly hold the pocket portion contiguously against the upper portion of the shoe particularly at the location of its lacing.

A further object of this invention is to provide a footwear pocket, conveniently built appending onto the structure of the shoe, and which incorporates an opening or slot into which personal items may be quickly inserted, for safety and storage, but which items do not exert any pressure or bind onto the wearer's foot during footwear usage.

Another object of this invention is to provide a shoe pocket integrally formed into the structure of the shoe and which can be conveniently and promptly installed during a stage of shoe assembly.

A further object of this invention is to provide resilient means within the structure of a shoe or footwear pocket that enhances the formation of the said pocket portion and for its locating contiguously against the upper part of the said shoe.

Still another object of this invention is to provide a pocket portion for a shoe and which contains supplemental strap means that may hold golf tees, or the like, to facilitate their usage.

These and other objects will become more apparent to those skilled in the art upon reviewing the summary of this invention, and upon undertaking a study of the description of its preferred embodiment in view of the drawings.

SUMMARY OF THE INVENTION

This invention contemplates the formation of a supplemental pocket for storage of smaller personal items, as aforesaid, and which pocket is appended to the gusset or formed tongue of the shoe, which normally underlies the lacing that ties the shoe upon the foot of its wearer. More specifically, the pocket portion is formed of a pair of liners, an upper and lower liner in structure, and which liners integrally foldably extend from the said footwear tongue, so as to freely appended from it, and capable of having the aforesaid type of items located therein, with said pocket portion then being folded over into an overlying relationship contiguously against the upper surface of the footwear, and more specifically overlying its lacing and eyestays. In this manner, any rigid items located within the pocket portion are independently supported by said portion, and do not bind against the footwear components, and therefore against the foot of the wearer, such as can occur with some of the prior art type of formed shoe containers.

In its construction, the pocket portion is formed of the pair of liners as previously explained, with the upper liner having an opening or slot provided therethrough, so that access can be obtained into the pocket, and with fastening means, such as a zipper, provided for closure of the said access opening after items have been located therein, although, said access opening could be located through the lower liner also. In addition, various fastening means are provided upon the lower liner of the pocket portion, and in one instance, a segment of VELCRO is provided along the edges of the formed pocket, and can interconnect and fasten with similar segments of Velcro provided aligned along the eyestays provided to either side of the footwear lacing. Thus, when the pocket portion is folded over into its overlying relationship during usage, and pressed, the VELCRO interconnects so as to maintain the snugness and contiguousness of the pocket portion upon the shoe upper, and thereby prevent its flapping during usage. So as to assure that the pocket portion does not come loose, another fastening means, in the nature of a hook, or the like, is provided proximate the bottom end of the formed pocket, securing upon the underliner, and which hook can clamp onto the lacing therebelow so as to assure that the pocket portion will remain intact, during footwear usage.

Supplemental means are provided for assuring that the pocket portion will undertake and maintain its proper positioning during shoe usage, and this includes the locating of a resilient means, such as wire, within the lower edge of the formed pocket, so that when the pocket is folded over into its usable configuration, and pressed, the malleable wire undertakes the configuration of the shoe upper, and thereby increases the ability of the pocket to remain intact. In addition, a pair of apertures are provided through the upper portion of the formed pocket, and have grommets secured therethrough, so that the upper strings of the lacing may be inserted therethrough, after their tightening in conjunction with the eyestays, and with said inserted lacings being tied in a bow, or other knot, for securely urging the upper part of the pocket portion downwardly against the located lacing, and thereby, once again, prevent the pocket portion from flapping during shoe usage.

Supplemental means are provided in conjunction with the formation of the pocket portion, to allow for the suspension of other usable items, such as a gold tee, when the pocket portion is structured into the configuration of a golf shoe, so as to allow the golfer to obtain ready access to the tees, when needed, but yet said tees are firmly held in place upon the shoe. This can be achieved by the locating of a strap or band fastened or otherwise stitched to the lower liner of the pocket portion, preferably being formed of some elastic material, so that a golf tee(s) may be inserted within its formed loop, and secured in place, as when not needed, but can be readily obtained by the golfer by simply lifting up of the pocket portion to obtain ready access to the tees.

It must be commented that the concept of this invention of providing a pocket portion, and one that may even have the supplemental elastic straps or bands applied to its underside, can be used upon a variety of footwear. For example, it can be used upon jogging shoes, tennis shoes, hunting boots, workshoes, casual loafers, or any of the variety of styles of shoes readily available upon the market.

DESCRIPTION OF THE PREFERRED EMBODIMENT

Figure 1:
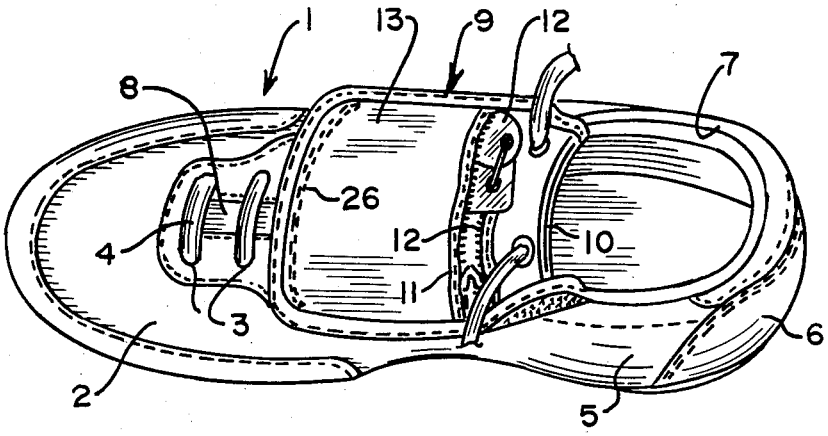
FIG. 1 discloses a plan view of the footwear with gusset pocket of this invention.
Figure 2:
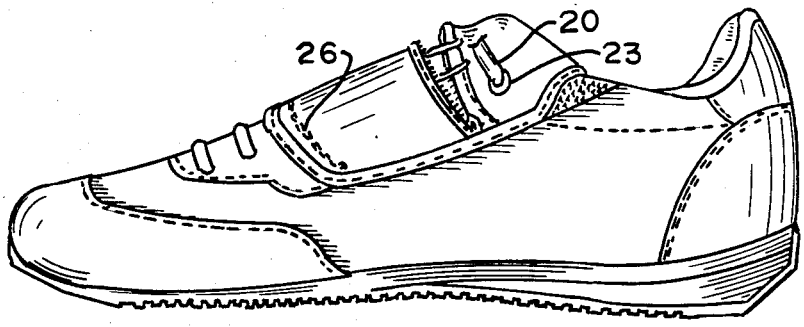
FIG. 2 provides a left side view of the footwear shown in FIG. 1.
Figure 3:
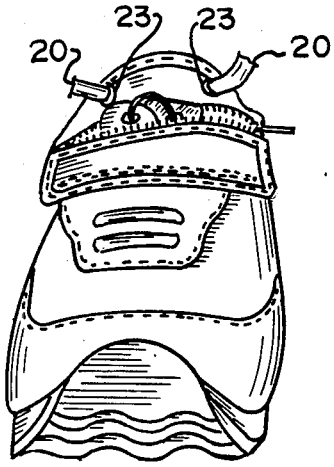
FIG. 3 provides a front view of the footwear shown in FIG. 1.

In referring to the drawings, and in particular FIGS. 1 through 3, there is shown a shoe 1 comprising, in this particular instance, an athletic shoe, as for use for jogging purposes, and which is formed having the usual components containing the vamp portion 2 having eye stay 3 containing the lacing 4 that is normally used for tying the shoe about the foot of the wearer. In addition, the shoe is formed having the usual quarter portions 5 and heel 6, having the located spacing 7 wherein the foot may be inserted. In this particular design, the shoe also contains the usual tongue or gusset portion 8 underlying the lacing, and in this particular instance, the upper part of the gusset is formed having integrally connected thereto a pocket portion 9 which is formed integrally folded, as at 10, with said gusset. As shown, this pocket portion contains an opening, as at 11, therethrough, and is provided with closure means, such as the zipper 12, as shown, which can be manipulated for providing closure to the pocket portion 9. This pocket is designed for holding keys, as at K, or other items of similar nature therein, for safekeeping during jogging, hiking, and where this particular feature is built into other type shoes, can be used for the safe keeping of similar type items during hunting, working, or the like.

Figure 4:
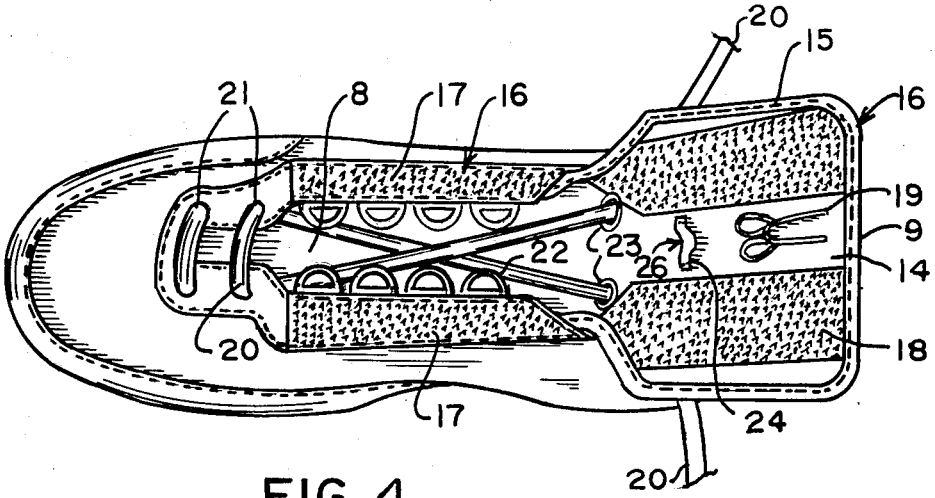
FIG. 4 discloses a plan view of the footwear of FIG. 1, with the pocket portion being folded upwardly to disclose lacing in the process of being secured through the eye stays of the footwear.

In referring to FIG. 4, it can be seen that the pocket portion 9 is clearly foldably connected with the gusset, or tongue of the shoe 8. The pocket portion is formed having an upper liner 13 and a lower liner 14, both of which are stitched together, as at 15, around their periphery, and in addition, if desired, stitching may be provided along the fold line 10, so as to prevent any items from sliding down into the gusset or tongue 8 of the formed pocket.

Once the personal items are located into position within the pocket portion, such being shown in the process of being accomplished in FIG. 1, the pocket portion is folded over into an overlying relationship with the shoe lacing, and can be adhered contiguously thereover, through the use of various fastening means, such as the VELCRO 16, as shown. Such VELCRO is provided aligned adjacent with each eyestay of the shoe, as at 17, with the complementary portion of the VELCRO as at 18, being provided along the approximate marginal side edges of the lower liner 14.

In addition, and to assure the retention of the pocket portion into its contiguous relationship upon the shoe lacing, a hook means 19 is provided, being secured with the lower liner 14 of the pocket portion, and when the said portion is folded over into its overlying relationship, said hook 19 may be conveniently disposed for hooking onto one of the lacing, as at 20, for assuring the retention, for as long as desired, of the pocket portion upon the shoe, and to prevent its flapping in place as when worn by a jogger.

Figure 5:
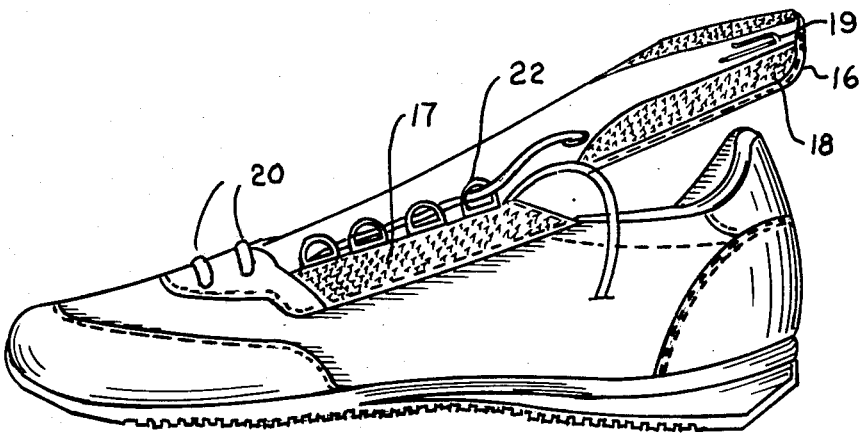
FIG. 5 provides a left side view of the footwear shown in FIG. 4.
Figure 6:
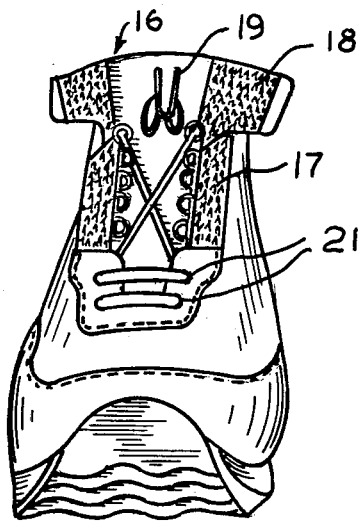
FIG. 6 discloses a front view of the footwear shown in FIG. 4.

Futhermore, and as also can be seen in FIGS. 4 through 6, the lacing secures normally through its various eyelets, as at 21, in addition to lacing through each of the eyestays, as at 22. Furthermore, once the lacing is aligned through the upper eyestay, as at 22, as shown, it is then inserted through a pair of apertures 23 provided through the pocket portion just marginally upwardly from the fold line 10, and when the pocket portion is then folded over into its contiguous position, the lacing is then tied in the form of a bow, or otherwise, for once again assuring the downward exertion of pressure upon the said pocket portion for its maintenance in contiguity upon the shoe upper and lacing. This can also be seen in FIGS. 2 and 3.

As a supplemental feature for this invention, a strap means 24 may be secured upon the lower liner 14 of the pocket portion, and may be formed of elastic material, or the like, and in this position provides an internal loop, as at 25, and under which various items, such as a golf tee, may be inserted, and retained in position, with its ready access being conveniently disposed for the golfer when he needs a tee for teeing up the ball upon the driving area. Thus, this added feature may be applied to the pocket portion when it is used in association upon a golf shoe.

In addition to the foregoing, and in order to assure that the pocket portion will remain in an overlying and contiguous relationship upon the shoe lacing, a resilient or malleable item, 26, such as a piece of wire, or plastic wire, may be stitched into approximately the lower seam of the pocket portion, as shown, and when the said portion is folded over into its overlying relationship, and pressed down upon its paired VELCRO segments, said wire will conform the pocket portion to the shape of the underlying shoe, and reasonably assure its retention in contiguity upon said shoe.

Variations or modifications to the shoe or footwear with gusset pocket may occur to those skilled in the art upon reviewing the subject matter of this invention. Such modifications or variations to this invention, as may occur to those skilled in the art upon reviewing the summary of the invention, if within the spirit of this invention, are intended to be encompassed within the scope of any claims to patent protection issuing upon this invention. The description of the preferred embodiment set forth herein is done so for illustrative purposes only.

Having thus described the invention what is claimed and desired to be secured by Letters Patent is:

1. An athletic shoe with a gusset normally positioned beneath the shoe lacing and other securing means, over the instep of the wearer's foot, and incorporating a pocket for holding a key, coin, and related item, comprising, said gusset incorporating a tongue, a lower portion of the tongue being located over the instep of the wearer's foot and under the lacing and other securing means on the said shoe when said shoe is being worn, an upper portion of said tongue extending above said shoe lacing, a foldable portion appended to said upper portion of the said tongue, a pocket formed in said foldable portion and capable of holding a key, coin, and related item therein, said foldable portion being foldable over against said lacing to a position wherein said pocket is adjacent said shoe when said shoe is being worn, said foldable portion of the said upper portion of the tongue and the pocket formed therein being integral, and said upper portion and said lower portion of said tongue being integrally formed, the upper portion of said tongue comprising a pair of upper and lower liners stitched along their lateral edges to form said pocket and having a width equal to the width of the tongue in which the pocket is formed, said pocket being formed having side edges, said liners extending above said lacing, and said liners folding over as the foldable portion upon said lacing to a position wherein said pocket is adjacent said shoe, an access opening permitting placement and removal of said key, coin, and related item, into and from said pocket while said shoe is being worn, closure means for closing said access opening, said closure means comprising a zipper, said access opening being provided through one of said upper or lower liners forming the said pocket, said access opening and closure means extending approximately from one side edge to the other side edge of said formed pocket, and releasable holding means for aiding and holding said pocket adjacent said shoe when said shoe is being worn, said releasable holding means comprising a hook and pile connector, one of said hook and pile connector attaching with the underside of the lower liner, and aligned for attaching with the other hook and pile connector securing upon the shoe eyestay, and securing means interconnecting between the formed pocket portion and the footwear for retaining the said portion contiguously against the same during usage.

2. The invention of claim 1 and wherein said securing means comprising a hook means connecting with the lower liner of the formed pocket portion, and said hook means capable of selectively attaching onto said lacing to secure said pocket in its folded condition adjacent said footwear lacing.

3. The invention of claim 1 and including resilient means in said folding portion capable of being molded to conform the shape of the formed pocket to the adjacent shoe, and wherein said resilient means comprises a wire.

4. The invention of claim 1 and wherein said folding portion of the pocket having apertures therein, and designed for receiving said lacing when the shoe is being worn, said lacing serving to aid in holding said pocket adjacent said shoe when said lacing is inserted through said apertures and tied.

5. The invention of claim 1 and including strap means provided upon the lower liner of the pocket portion, and being formed of elastic material, said strap means disposed for retention of an item therein.

6. The invention of claim 5 and wherein said item comprising a golf tee.

* * * * *